US008428480B2

(12) United States Patent
Takenaka et al.

(10) Patent No.: US 8,428,480 B2
(45) Date of Patent: Apr. 23, 2013

(54) FIXING DEVICE, IMAGE FORMING APPARATUS INCORPORATING SAME, AND METHOD OF DIMENSIONING FIXING DEVICE

(75) Inventors: Kohta Takenaka, Yokohama (JP); Kazunori Bannai, Atsugi (JP); Yu Wakabayashi, Ebina (JP); Toshihiro Shimada, Kawasaki (JP); Hidehiko Fujiwara, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 372 days.

(21) Appl. No.: 12/926,044

(22) Filed: Oct. 22, 2010

(65) Prior Publication Data

US 2011/0116822 A1 May 19, 2011

(30) Foreign Application Priority Data

Nov. 13, 2009 (JP) ..... 2009-259884

(51) Int. Cl.
*G03G 15/20* (2006.01)

(52) U.S. Cl.
USPC ..... 399/67; 399/69; 399/329

(58) Field of Classification Search ..... 399/67, 399/69, 328, 329
See application file for complete search history.

(56) References Cited

U.S. PATENT DOCUMENTS

| | | | |
|---|---|---|---|
| 6,151,466 | A | 11/2000 | Fujiwara |
| 6,542,712 | B2 | 4/2003 | Kamijo et al. |
| 6,731,900 | B2 | 5/2004 | Takenaka et al. |
| 6,731,902 | B2 | 5/2004 | Takenaka et al. |
| 6,788,916 | B2 | 9/2004 | Takenaka et al. |
| 6,801,744 | B2 | 10/2004 | Fujiwara et al. |
| 6,907,218 | B2 | 6/2005 | Fujiwara et al. |
| 7,013,108 | B2 | 3/2006 | Takenaka et al. |
| 7,454,157 | B2 | 11/2008 | Yamada et al. |
| 2003/0026632 | A1 | 2/2003 | Takenaka et al. |
| 2003/0063933 | A1 | 4/2003 | Fujiwara et al. |
| 2003/0063934 | A1 | 4/2003 | Takenaka et al. |
| 2003/0099493 | A1 | 5/2003 | Takenaka et al. |
| 2003/0103786 | A1 | 6/2003 | Fujiwara et al. |
| 2004/0240914 | A1 | 12/2004 | Takenaka et al. |
| 2007/0059036 | A1 | 3/2007 | Yamada et al. |
| 2008/0124152 | A1 | 5/2008 | Nishikawa et al. |
| 2009/0010688 | A1 | 1/2009 | Takahashi et al. |
| 2009/0116884 | A1 | 5/2009 | Nonaka et al. |
| 2009/0148207 | A1 | 6/2009 | Yamada et al. |
| 2009/0208264 | A1 | 8/2009 | Fujiwara et al. |
| 2010/0008691 | A1 | 1/2010 | Fujiwara |
| 2010/0232822 | A1 | 9/2010 | Takenaka et al. |
| 2011/0020018 | A1 | 1/2011 | Takenaka et al. |
| 2011/0026961 | A1 | 2/2011 | Ohta et al. |

FOREIGN PATENT DOCUMENTS

| | | | |
|---|---|---|---|
| JP | 09-265244 | A | 10/1997 |
| JP | 2002-006656 | A | 1/2002 |
| JP | 2007-017495 | A | 1/2007 |
| JP | 2008-129092 | A | 6/2008 |

*Primary Examiner* — William J Royer
(74) *Attorney, Agent, or Firm* — Harness, Dickey & Pierce, P.L.C.

(57) ABSTRACT

A fixing device includes a fixing member, a pressing member, a temperature detector, and a heater. The pressing member contacts an outer circumferential surface of the fixing member to form a fixing nip between the fixing member and the pressing member through which a recording medium bearing a toner image passes. The heater heats the fixing member to a predetermined temperature based on a detection result provided by the temperature detector. A circumferential distance A between the temperature detector and the heater along a circumference of the fixing member is defined by the following formula:

$$A \geqq v \times (T1 + T2)$$

where v is a circumferential velocity of the fixing member rotating in a predetermined direction of rotation, T1 is a response time of the temperature detector, and T2 is a response time of the heater.

8 Claims, 5 Drawing Sheets

BEFORE DETECTED

WHEN DETECTED

WHEN HEAT SUPPLY IS STARTED

DURING HEAT SUPPLY

BEFORE DETECTED

WHEN DETECTED

WHEN HEAT SUPPLY IS STARTED

DURING HEAT SUPPLY

FIXING DEVICE, IMAGE FORMING APPARATUS INCORPORATING SAME, AND METHOD OF DIMENSIONING FIXING DEVICE

PRIORITY STATEMENT

The present patent application claims priority from Japanese Patent Application No. 2009-259884, filed on Nov. 13, 2009 in the Japan Patent Office, which is hereby incorporated herein by reference in its entirety.

BACKGROUND OF THE INVENTION

1. Field of the Invention

Example embodiments generally relate to a fixing device, an image forming apparatus, and a method of dimensioning the fixing device, and more particularly, to a fixing device for fixing a toner image on a recording medium, and an image forming apparatus including the fixing device, and the method of dimensioning the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may use a fixing film having a small heat capacity in place of the usual fixing roller to shorten the warm-up time of the fixing device. A heater provided inside a loop into which the endless fixing film is formed presses the fixing film against an adjacent pressing roller to form a fixing nip between the fixing film and the pressing roller through which the recording medium passes. As the recording medium bearing the toner image is passed through the fixing nip between the heater and the pressing roller by the fixing film, the fixing film heated by the heater and the pressing roller apply heat and pressure to the recording medium to fix the toner image on the recording medium.

However, the heater provided at the fixing nip has a drawback in that the fixing film heated by the heater increases the temperature of the recording medium as the recording medium moves through the fixing nip, resulting in a decreased gloss of the toner image fixed on the recording medium.

To address this problem, the fixing device may include a halogen lamp provided inside a hollow interior of a fixing roller not at the center of the fixing roller but offset to a position upstream from the fixing nip in the direction of rotation of the fixing roller. The pressing roller is pressed against the fixing roller to form a fixing nip between the pressing roller and the fixing roller through which the recording medium bearing the toner image passes. A temperature detector presses against the outer circumferential surface of the fixing roller at a position downstream from the fixing nip in the direction of rotation of the fixing roller to detect the temperature of the outer circumferential surface of the fixing roller. A temperature control circuit then controls power supply to the halogen lamp based on a detection signal provided by the temperature detector to adjust the temperature of the outer circumferential surface of the fixing roller at a predetermined temperature.

However, a drawback of the above-described arrangement is that, if relative positions of the temperature detector and the halogen lamp are not considered, the fixing roller may not be heated by the halogen lamp at the proper time. For example, a portion of the fixing roller which has a decreased temperature after heat is drawn by the recording medium at the fixing nip may already pass the halogen lamp when the halogen lamp starts supplying heat to the fixing roller. Accordingly, the portion of the fixing roller having the decreased temperature enters the fixing nip without being heated to a proper fixing temperature, resulting in faulty fixing of the toner image on the recording medium.

SUMMARY

At least one embodiment may provide a fixing device that fixes a toner image on a recording medium and includes a fixing member, a pressing member, a temperature detector, and a heater. The fixing member rotates in a predetermined direction of rotation, and is formed in a loop. The pressing member contacts an outer circumferential surface of the fixing member to form a fixing nip between the fixing member and the pressing member through which the recording medium bearing the toner image passes. The temperature detector faces the fixing member to detect a temperature of the fixing member. The heater faces the fixing member to heat the fixing member to a predetermined temperature based on a detection result provided by the temperature detector.

The heater is disposed with respect to the temperature detector with a circumferential distance A between the temperature detector and the heater along a circumference of the fixing member defined by the following formula:

$$A \geqq v \times (T1 + T2)$$

where v is a circumferential velocity of the fixing member rotating in the predetermined direction of rotation, T1 is a response time of the temperature detector, and T2 is a response time of the heater.

At least one embodiment may provide an image forming apparatus that includes the fixing device described above.

At least one embodiment may provide a method of dimensioning a fixing device for fixing a toner image on a recording medium, which includes the steps of:

obtaining a circumferential velocity v of a fixing member rotating in a predetermined direction of rotation, a response time T1 of a temperature detector that detects a temperature of the fixing member, and a response time T2 of a heater that heats the fixing member to a predetermined temperature based on a detection result provided by the temperature detector;

positioning the temperature detector downstream and the heater upstream from a fixing nip formed between the fixing member and a pressing member contacting the fixing member in a recording medium conveyance direction in which the recording medium is conveyed through the fixing nip; and setting a distance A between the temperature detector and the heater along a circumference of the fixing member such that $A \geqq v \times (T1+T2)$.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
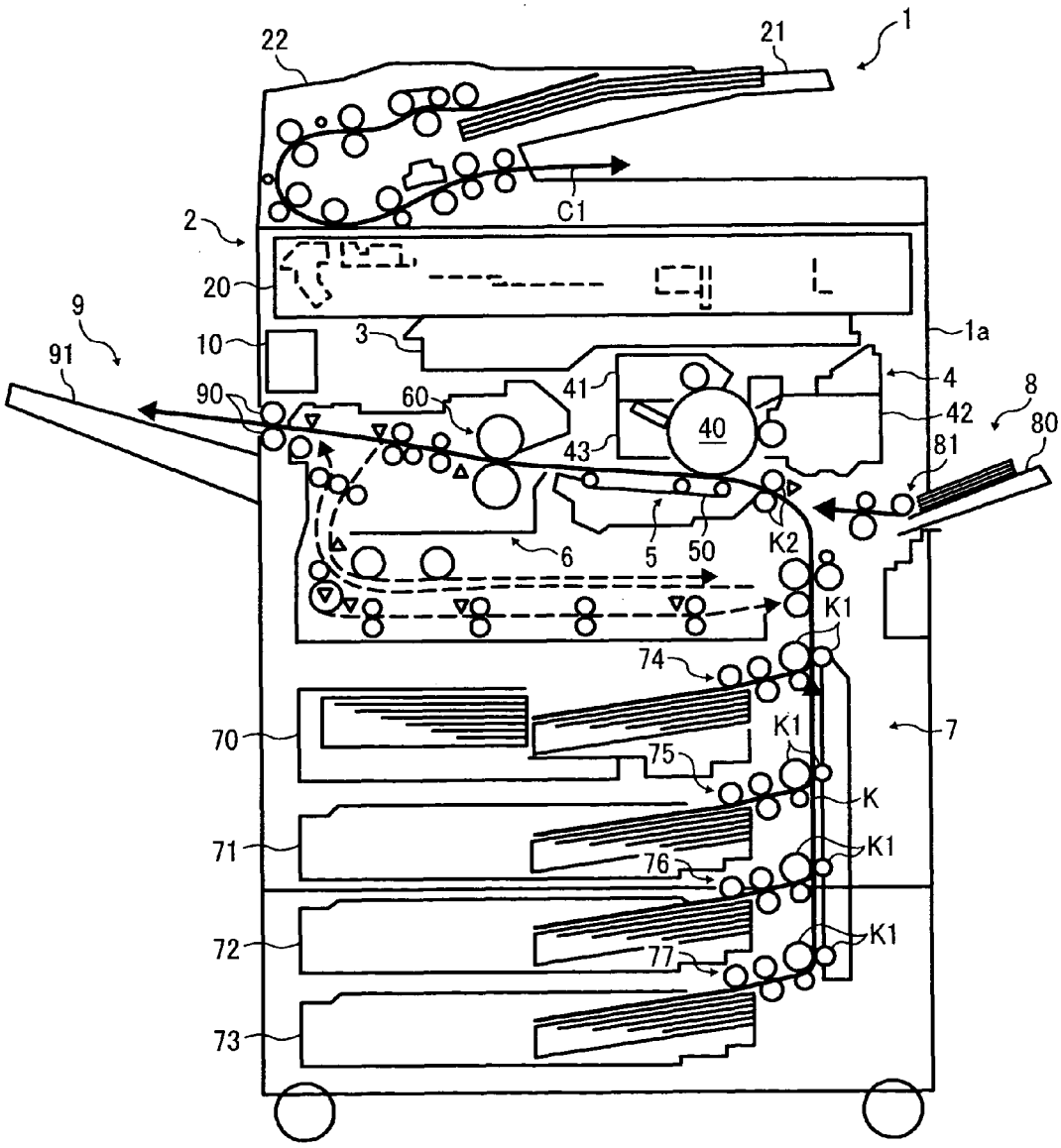
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic front view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. The image forming apparatus 1 may form a color image and/or a monochrome image by electrophotography. According to this example embodiment, the image forming apparatus 1 is a copier for forming an image on a recording medium by electrophotography.

As illustrated in FIG. 1, the image forming apparatus 1 includes a body 1*a*. The body 1*a* includes an original reader 2, an exposure device 3, an image forming device 4, a transfer device 5, a fixing portion 6, a paper tray portion 7, a bypass tray portion 8, an output tray portion 9, a controller 10, a conveyance path K, conveyance roller pairs K1, and a registration roller pair K2.

The original reader 2 includes an optical reader 20, an input tray 21, and an auto document feeder (ADF) 22. The image forming device 4 includes a photoconductive drum 40, a charger 41, a development device 42, and a cleaner 43. The transfer device 5 includes a conveyance belt 50. The fixing portion 6 includes a fixing device 60. The paper tray portion 7 includes paper trays 70, 71, 72, and 73, and sheet separators 74, 75, 76, and 77. The bypass tray portion 8 includes a bypass tray 80 and a sheet separator 81. The output tray portion 9 includes an output roller pair 90 and an output tray 91.

The body 1*a* is a housing of the image forming apparatus 1. The original reader 2 is provided in an uppermost portion of the body 1*a*, and serves as a scanner or an image reading device that optically reads an image on an original document fed by the ADF 22. The exposure device 3 is provided immediately below the original reader 2, and exposes an outer circumferential surface of the photoconductive drum 40 to form an electrostatic latent image on the photoconductive drum 40. The image forming device 4 is provided immediately below the exposure device 3, and makes the electrostatic latent image formed on the photoconductive drum 40 visible as a toner image. The transfer device 5 is provided immediately below the image forming device 4, and transfers the toner image formed on the photoconductive drum 40 onto a sheet, serving as a recording medium, sent from the paper tray portion 7. The fixing portion 6 is provided downstream from the transfer device 5 in a sheet conveyance direction at a position near a left side of the body 1*a* in FIG. 1, and fixes the toner image on the sheet. The paper tray portion 7 is provided in a lower portion of the body 1*a*, and supplies a sheet (e.g., plain paper) to the transfer device 5. The bypass tray portion 8 is provided outside a right side of the body 1*a* in FIG. 1, and supplies a sheet (e.g., thick paper or a postcard) placed thereon by a user to the transfer device 5. The output tray portion 9 is provided outside the left side of the body 1*a* in FIG. 1 opposite the right side of the body 1*a* provided with the bypass tray portion 8, and receives the sheet bearing the fixed toner image sent from the fixing portion 6.

In the original reader 2, the ADF 22 is openably provided on a transparent exposure glass, and automatically feeds an original document placed on the input tray 21 to the exposure glass. The optical reader 20 reads an image on the original document through the exposure glass. The optical reader 20 includes a movable light source (e.g., an exposure lamp) and a movable optical system including mirrors that move with the moving light source. For example, the light source emits a light beam onto the original document placed on the exposure glass. The light beam reflected by the original document enters an image reading element, such as a charge-coupled device (CCD), via the mirrors and an image forming lens to form an image on the image reading element. Thus, the optical reader 20 reads the image on the original document to generate image data, converts the image data into an electric signal, and sends the electric signal to the controller 10.

The optical reader 20 reads an image on an original document placed on the exposure glass manually by the user or reads an image on an original document conveyed to the exposure glass automatically by the ADF 22.

The exposure device 3 includes a light source such as a laser diode (LD) and an optical scan system including a polygon mirror, that is, a rotatable polygonal mirror, a polygon motor that drives the polygon mirror, an fθ lens, and mirrors. For example, the light source emits a laser beam to the optical scan system. The optical scan system causes the laser beam to scan the outer circumferential surface of the photoconductive drum 40 to selectively expose the outer circumferential surface of the photoconductive drum 40 so as to form an electrostatic latent image on the photoconductive drum 40. Thus, the exposure device 3 serves as a writer that writes the electrostatic latent image on the photoconductive drum 40.

The photoconductive drum 40, serving as an electrostatic latent image carrier having a drum shape, is provided at a center of the image forming device 4. The charger 41, the development device 42, and the cleaner 43 are arranged along the outer circumferential surface of the photoconductive drum 40.

In a charging process, the charger 41 uniformly charges the outer circumferential surface of the photoconductive drum 40. In an exposure process, the exposure device 3 selectively emits a laser beam onto the outer circumferential surface of the photoconductive drum 40 according to the image data sent from the original reader 2 to decrease a charging level of the outer circumferential surface of the photoconductive drum 40 to write an electrostatic latent image on the photoconductive drum 40. In a development process, the development device 42 transfers toner to the electrostatic latent image formed on the photoconductive drum 40 by using an electrostatic force to make the electrostatic latent image visible as a toner image. Thus, the image forming device 4 forms the toner image on the outer circumferential surface of the photoconductive drum 40. The cleaner 43 includes a cleaning blade that scrapes residual toner adhered to the photoconductive drum 40 off the photoconductive drum 40 after the transfer device 5 transfers the toner image formed on the photoconductive drum 40 to the sheet.

The transfer device 5 includes the conveyance belt 50 that conveys a sheet sent from the paper tray portion 7 and a transfer bias application member that applies a transfer bias to a transfer nip formed between the conveyance belt 50 and the photoconductive drum 40. For example, the conveyance belt 50 is pressed against the photoconductive drum 40 to form the transfer nip between the conveyance belt 50 and the photoconductive drum 40. The transfer bias application member applies a transfer bias to the transfer nip via the conveyance belt 50 to transfer the toner image formed on the outer circumferential surface of the photoconductive drum 40 onto a surface of the sheet, which is conveyed by the conveyance belt 50, by an electrostatic force. Thus, the transfer device 5 transfers the toner image formed on the photoconductive drum 40 onto the sheet directly.

In the fixing portion 6, the fixing device 60 applies heat and pressure to the sheet bearing the toner image transferred by the transfer device 5 to fix the toner image on the sheet.

The paper tray portion 7 includes the four-layer paper trays 70, 71, 72, and 73 that contain sheets of predetermined sizes, respectively, and the sheet separators 74, 75, 76, and 77 that correspond to the paper trays 70, 71, 72, and 73, respectively. One of the sheet separators 74, 75, 76, and 77 corresponding to one of the paper trays 70, 71, 72, and 73 selected by the controller 10 picks up and feeds a sheet from the selected paper tray 70, 71, 72, or 73 to the conveyance path K in such a manner that the one of the sheet separators 74, 75, 76, and 77 separates the picked-up sheet from other sheets loaded on the selected paper tray 70, 71, 72, or 73. The sheet is conveyed through the conveyance path K provided between the paper trays 70, 71, 72, and 73 and the transfer nip formed between the photoconductive drum 40 and the conveyance belt 50. The plurality of conveyance roller pairs K1 are provided in the conveyance path K with a predetermined distance provided between the adjacent conveyance roller pairs K1, and feeds the sheet sent from the sheet separator 74, 75, 76, or 77 to the registration roller pair K2. The registration roller pair K2 is provided in the conveyance path K, and sends the sheet fed by the conveyance roller pair K1 to the transfer nip formed between the photoconductive drum 40 and the conveyance belt 50 so that a leading edge of the sheet reaches the transfer nip at a proper time at which the toner image formed on the photoconductive drum 40 is transferred onto a desired position on the sheet.

The bypass tray portion 8 is generally used for feeding a special sheet, such as thick paper and a postcard, and includes the bypass tray 80 and the sheet separator 81. The sheet separator 81 feeds a sheet set manually by the user to the conveyance path K connected to the bypass tray 80. The sheet is conveyed through the conveyance path K to the transfer nip formed between the photoconductive drum 40 and the conveyance belt 50.

The output tray portion 9 includes the output roller pair 90 and the output tray 91. The output roller pair 90 discharges the sheet bearing the fixed toner image sent from the fixing device 60 to the output tray 91 provided outside the body 1*a*. The output tray 91 receives the sheet fed by the output roller pair 90. When the output roller pair 90 discharges a plurality of sheets successively, the plurality of sheets are stacked on the output tray 91.

Referring to FIG. 1, the following describes image forming processes and operation of the image forming apparatus 1.

The ADF 22 conveys an original document placed on the input tray 21 in a direction C1 to the optical reader 20. While the original document passes over the exposure glass of the optical reader 20, the optical reader 20 optically reads an image on the original document to generate image data, and converts the image data into an electric signal. The electric signal is sent to the controller 10.

In the image forming device 4, the above-described charging, exposure, and development processes are performed on the photoconductive drum 40 while the photoconductive drum 40 rotates clockwise in FIG. 1. For example, the exposure device 3 writes an electrostatic latent image on the outer circumferential surface of the photoconductive drum 40 charged by the charger 41 according to the electric signal received by the controller 10. The development device 42 makes the electrostatic latent image formed on the photoconductive drum 40 visible as a toner image. Thus, the toner image is formed on the photoconductive drum 40 according to the image data generated by the original reader 2.

The controller 10 selects one of the paper trays 70, 71, 72, and 73 according to the size of the original document read by the original reader 2 or the sheet size specified by the user. One of the sheet separators 74, 75, 76, and 77 corresponding to the selected one of the paper trays 70, 71, 72, and 73 picks up and feeds an uppermost sheet of a plurality of sheets loaded on the selected one of the paper trays 70, 71, 72, and 73 to the conveyance roller pair K1 in such a manner that the one of the sheet separators 74, 75, 76, and 77 separates the uppermost sheet from other sheets. The conveyance roller pair K1 conveys the uppermost sheet to the transfer device 5 through the conveyance path K.

When the uppermost sheet reaches and contacts the registration roller pair K2, the registration roller pair K2 stops the sheet temporarily. Thereafter, the registration roller pair K2 resumes rotating to feed the sheet to the transfer nip formed between the photoconductive drum 40 and the conveyance belt 50 so that the toner image formed on the photoconductive drum 40 contacts a proper position on the sheet conveyed by the conveyance belt 50.

Alternatively, when the controller 10 selects the bypass tray 80, the sheet separator 81 picks up and feeds an uppermost sheet of a plurality of sheets placed on the bypass tray 80 to the registration roller pair K2.

The transfer bias application member applies a transfer bias to the transfer nip formed between the photoconductive drum 40 and the conveyance belt 50 to transfer the toner image formed on the photoconductive drum 40 onto the sheet in a transfer process. Thereafter, the sheet bearing the toner image is conveyed by the conveyance belt 50 to a fixing nip formed in the fixing device 60.

The fixing device 60 applies heat and pressure to the sheet bearing the toner image at the fixing nip to fix the toner image on the sheet by melting toner of the toner image to cause the toner to permeate the sheet. Finally, the output roller pair 90 discharges the sheet bearing the fixed toner image from the body 1*a* of the image forming apparatus 1. Accordingly, the sheet is stacked on the output tray 91, completing a series of image forming processes.

Figure 2:
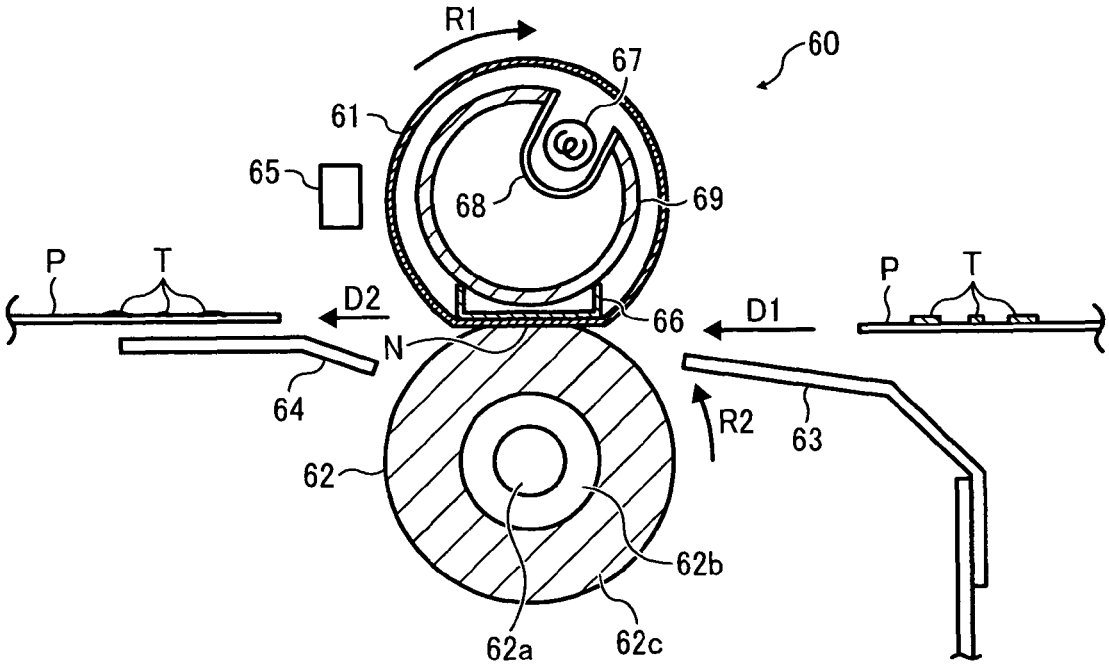
FIG. 2 is a sectional view (according to an example embodiment) of a fixing device included in the image forming apparatus shown in FIG. 1.
Figure 3:
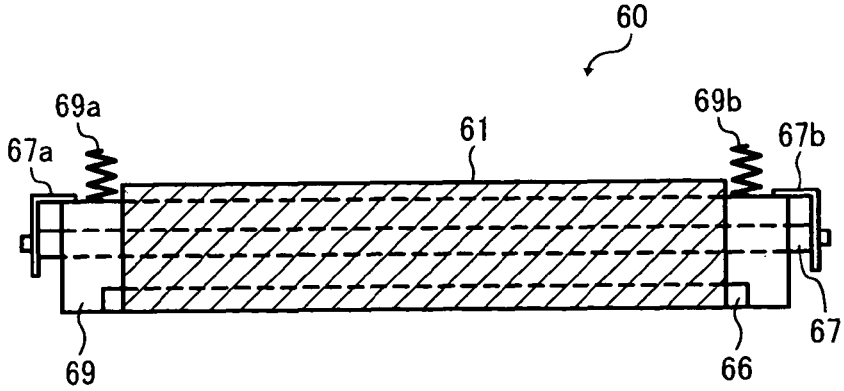
FIG. 3 is a side view of the fixing device shown in FIG. 2.

Referring to FIGS. 2 and 3, the following describes the structure of the fixing device 60. FIG. 2 is a sectional view of the fixing device 60. FIG. 3 is a side view of the fixing device 60. As illustrated in FIG. 2, the fixing device 60 includes a fixing film 61, a pressing roller 62, an entry guide plate 63, an exit guide plate 64, a temperature sensor 65, a pressing plate 66, an infrared heater 67, a reflection plate 68, and a support member 69. The pressing roller 62 includes a shaft 62*a*, a metal core 62*b*, and an elastic layer 62*c*.

As illustrated in FIG. 3, the fixing device 60 further includes holders 67*a* and 67*b* and compression springs 69*a* and 69*b*.

The fixing film 61 is an endless film serving as a fixing member that contacts a sheet P serving as a recording medium bearing a toner image T and transmits heat to the sheet P. The pressing roller 62 serves as a pressing member that presses against the pressing plate 66 via the fixing film 61 to form a fixing nip N between the pressing roller 62 and the fixing film 61. The entry guide plate 63 guides the sheet P bearing the unfixed toner image T to the fixing nip N. The exit guide plate 64 guides the sheet P bearing the fixed toner image T discharged from the fixing nip N to a conveyance path that conveys the sheet P to the output roller pair 90 depicted in FIG. 1. The temperature sensor 65 serves as a temperature detector that detects a temperature of an outer circumferential surface of the fixing film 61. The fixing film 61, the pressing roller 62, the entry guide plate 63, the exit guide plate 64, and the temperature sensor 65 are provided inside a housing of the fixing device 60.

The fixing film 61 includes a base layer and a release layer provided on the base layer. The base layer is a thin, flexible endless film having an endless belt shape and a small heat capacity, and includes polyimide, polyamide, fluorocarbon resin, metal, and/or the like. The release layer is provided on an outer circumferential surface of the base layer, and provides an improved releasing property for separating toner of the toner image T on the sheet P from the fixing film 61. The release layer includes tetrafluoroethylene-perfluoroalkylvinylether copolymer (PFA), polyimide, polyetherimide, polyether sulfide (PES), and/or the like. The fixing film 61 is pressed against the pressing roller 62, and rotates in accordance with rotation of the pressing roller 62 in a rotation direction R1.

The pressing plate 66 is provided inside a loop formed by the fixing film 61, and serves as a contact member that contacts an inner circumferential surface of the fixing film 61 and presses the fixing film 61 against the pressing roller 62 to form the fixing nip N between the fixing film 61 and the pressing roller 62. The infrared heater 67 is provided inside the loop formed by the fixing film 61, and serves as a heater that heats the fixing film 61 and the pressing plate 66. The reflection plate 68 is provided inside the loop formed by the fixing film 61, and reflects or deflects heat rays (e.g., infrared rays) generated by the infrared heater 67 in a desired direction. The support member 69 is provided inside the loop formed by the fixing film 61, and supports the pressing plate 66, the infrared heater 67, and the reflection plate 68.

An absorption layer may be provided on the inner circumferential surface of the fixing film 61 to facilitate absorption of heat rays generated by the infrared heater 67. For example, the inner circumferential surface of the fixing film 61 is coated black to improve its absorption rate, that is, heat conversion rate, of heat rays so as to enhance heating efficiency of the infrared heater 67 for heating the fixing film 61.

The pressing roller 62 is a roller having a cylindrical drum shape and is constructed of the shaft 62*a;* the cylindrical metal core 62*b* provided on the shaft 62*a;* and the elastic layer 62*c* provided on the metal core 62*b* and including elastic resin such as fluorocarbon rubber, silicon rubber, silicon rubber foam, and/or the like. A thin release layer is provided on the elastic layer 62*c* as an outer circumferential surface of the pressing roller 62, and includes PFA. The shaft 62*a* of the pressing roller 62 is supported by a housing of the fixing device 60 in such a manner that a driving mechanism rotates the pressing roller 62 counterclockwise in FIG. 2 in a rotation direction R2. The entry guide plate 63 and the exit guide plate 64 are mounted on the housing of the fixing device 60 and supported by the housing.

The temperature sensor 65 is an optical sensor disposed opposite the outer circumferential surface of the fixing film 61 with a predetermined gap provided between the temperature sensor 65 and the fixing film 61. The temperature sensor 65 optically detects a surface temperature of the fixing film 61 and sends a detection result to the controller 10 (depicted in FIG. 1) that controls the fixing device 60. The controller 10 controls output of a power source to the infrared heater 67 based on the detection result provided by the temperature sensor 65 to control the surface temperature of the fixing film 61.

The pressing plate 66 is a metal plate having a thickness of about 0.1 mm. A longitudinal direction of the pressing plate 66 is parallel to an axial direction of the pressing roller 62. The pressing plate 66 has a U-like shape in cross-section as illustrated in FIG. 2. Specifically, an outer surface of the pressing plate 66 facing the pressing roller 62 is flat and is substantially parallel to an image side of the sheet P bearing the toner image T. An upstream edge and a downstream edge of the pressing plate 66 provided upstream and downstream from the fixing nip N in the sheet conveyance direction, respectively, are both bent substantially at a right angle to the flat side, and attached to the support member 69.

As illustrated in FIG. 3, the compression springs 69*a* and 69*b,* together serving as a biasing member, press the pressing plate 66 against the pressing roller 62 via the support member 69 to form the fixing nip N between the pressing plate 66 and the pressing roller 62, with the fixing film 61 interposed therebetween.

The planar outer surface of the pressing plate 66 facing the pressing roller 62 adheres the fixing film 61 to the sheet P to improve a fixing property and suppress curling and wrinkling of the sheet P passing through the fixing nip N. The downstream edge of the pressing plate 66 bent substantially at a right angle increases a curvature of the fixing film 61 moving over the downstream edge of the pressing plate 66 to facilitate separation of the sheet P discharged from the fixing nip N from the fixing film 61.

The outer surface of the pressing plate 66, over which the fixing film 61 slides, may be coated with diamond-like carbon (DLC) to reduce wear of the inner circumferential surface of the fixing film 61 sliding over the pressing plate 66.

The infrared heater 67 is a carbon heater that emits heat rays, such as infrared rays, to heat the fixing film 61 directly and indirectly via the pressing plate 66. As illustrated in FIG. 3, lateral ends of the infrared heater 67 in a longitudinal direction of the infrared heater 67 are supported by the support member 69 via the holders 67*a* and 67*b*, respectively.

Figure 4:
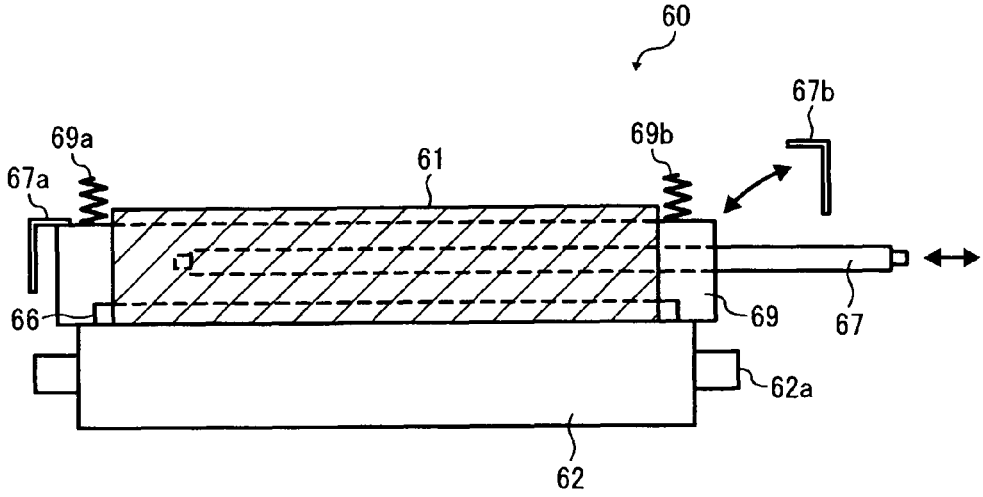
FIG. 4 is a side view of the fixing device shown in FIG. 3 in a state in which an infrared heater included in the fixing device is detached from the fixing device.

FIG. 4 is a side view of the fixing device 60 when the infrared heater 67 is detached from the fixing device 60. When the holders 67*a* and 67*b* are detached from the fixing device 60, the infrared heater 67 is detached from the fixing device 60 without releasing pressure applied at the fixing nip N.

The infrared heater 67 may be replaced by a heater that emits heat rays other than infrared rays, such as a halogen heater. However, a carbon heater, when compared to a halogen heater, provides advantages of increased flexibility in turning on and off. For example, even when power supply is turned off repeatedly before a duty of the carbon heater reaches 100 percent, the carbon heater is hardly disconnected, and decreasing of output of the carbon heater over time is reduced.

The infrared heater 67 may have a shape that improves heating efficiency of the infrared heater 67 for heating the fixing film 61, for example, a shape that increases the amount of heat rays, such as infrared rays, emitted by the infrared hater 67 in a direction of the normal to the fixing film 61.

As illustrated in FIG. 2, the reflection plate 68 is a concave mirror manufactured by mirror-finishing a surface of a sheet of aluminum, and is provided at a position separated from the infrared heater 67. The reflection plate 68 reflects infrared rays emitted by the infrared heater 67 onto the fixing film 61 so that the fixing film 61 and the pressing plate 66 receive more infrared rays to improve heating efficiency for heating the fixing film 61.

According to this example embodiment, the reflection plate 68 is separated from the infrared heater 67. Alternatively, the infrared heater 67 and the reflection plate 68 may be replaced by a halogen heater in which a part of a glass tube of the heater is gilded or treated with aluminum-vapor-deposition to serve as a reflection plate.

The support member 69 includes heat-resistant resin and has a hollow cylindrical shape. The support member 69 integrally supports the pressing plate 66, the infrared heater 67, and the reflection plate 68 provided inside the loop formed by the fixing film 61. A cylindrical, outer circumferential surface of the support member 69 guides the fixing film 61 rotated by the pressing roller 62. As illustrated in FIG. 3, the compression springs 69*a* and 69*b* press lateral ends of the support member 69 in an axial direction of the support member 69 against the pressing roller 62 provided below the support member 69 in FIG. 4. Accordingly, the pressing plate 66 attached to a lower portion of the support member 69 in FIG. 2 presses against the pressing roller 62 via the fixing film 61 to form the fixing nip N between the pressing plate 66 and the pressing roller 62.

Referring to FIG. 4, the following describes a process of detaching the infrared heater 67 from the fixing device 60 for maintenance and/or repair.

One of the two holders, that is, the holder 67*b* secured to the support member 69 with a screw, is removed from the support member 69. Thereafter, the infrared heater 67 is pulled from one of the lateral ends of the support member 69 in the axial direction of the support member 69, that is, the lateral end from which the holder 67*b* is removed. The new infrared heater 67 is inserted into the support member 69, and the removed holder 67*b* is reattached to the support member 69 and the infrared heater 67. Thus, the used infrared heater 67 is replaced with the new infrared heater 67.

Referring to FIGS. 1 and 2, the following describes operations of the fixing device 60.

When the image forming apparatus 1 is powered on, power is supplied to the infrared heater 67, and the pressing roller 62 rotates in the rotation direction R2. Accordingly, friction between the pressing roller 62 and the fixing film 61 rotates the fixing film 61 in the rotation direction R1. Thereafter, a sheet P is supplied from the paper tray portion 7 to the transfer device 5. The transfer device 5 transfers a toner image T formed on the photoconductive drum 40 onto the sheet P. The sheet P bearing the toner image T is conveyed in a direction D1 while guided by the entry guide plate 63, and enters the fixing nip N formed between the fixing film 61 and the pressing roller 62 pressed against the pressing plate 66 via the fixing film 61.

The fixing film 61 heated by the infrared heater 67 and the pressing plate 66 applies heat to the sheet P bearing the toner image T. Simultaneously, the pressing roller 62 pressed against the pressing plate 66 via the fixing film 61 applies pressure, that is, pressure applied by the compression springs 69*a* and 69*b* depicted in FIG. 3, serving as a biasing member, to the sheet P bearing the toner image T. Thus, the heat and the pressure fix the toner image T on the sheet P. Thereafter, the sheet P discharged from the fixing nip N is conveyed in a direction D2.

In the fixing device 60 according to the above-described example embodiment, the fixing film 61 having a small heat capacity serves as a fixing member that contacts the sheet P to transmit heat to the sheet P. Accordingly, the fixing device 60 is warmed up with a shortened time.

The infrared heater 67, serving as a heater, is separated from the fixing film 61 and the reflection plate 68. In other words, a predetermined gap is provided between the infrared heater 67 and the fixing film 61. Similarly, a predetermined gap is provided between the infrared heater 67 and the reflection plate 68. Accordingly, even when the fixing device 60 is transported in a state in which the pressing plate 66 is pressed against the pressing roller 62 via the fixing film 61, the infrared heater 67 does not contact the fixing film 61 and the reflection plate 68, reducing or preventing breakage of the infrared heater 67.

Further, even when a jammed sheet P is extracted in a state in which the pressing plate 66 is pressed against the pressing roller 62 via the fixing film 61, the infrared heater 67 does not contact the fixing film 61 and the reflection plate 68, thereby reducing or preventing breakage of the infrared heater 67.

The support member 69 integrally supports the pressing plate 66, the infrared heater 67, and the reflection plate 68. The compression springs 69*a* and 69*b* (depicted in FIG. 3) contacting the support member 69 press the pressing plate 66 against the pressing roller 62 via the fixing film 61, simplifying a driving mechanism and a pressing mechanism of the fixing device 60. Moreover, the infrared heater 67, which needs to be replaced frequently, is replaced with a new one easily without a pressure release mechanism that releases pressure applied at the fixing nip N, thus facilitating maintenance of the fixing device 60.

Figure 5:
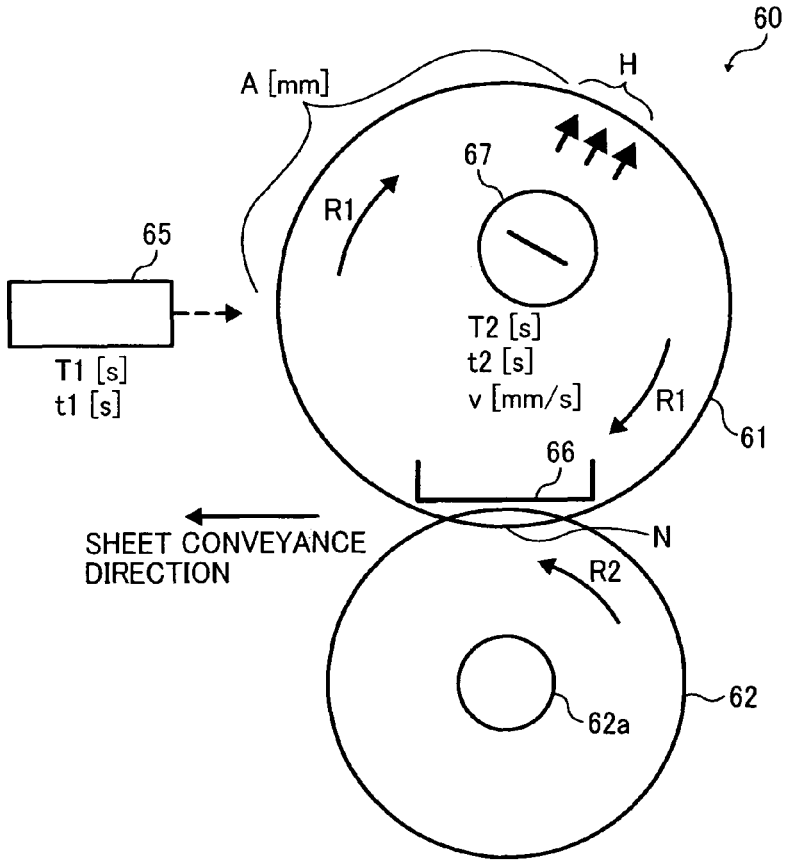
FIG. 5 is a sectional view of the fixing device shown in FIG. 2 showing relative positions of a temperature sensor and an infrared heater included in the fixing device.

Referring to FIGS. 5, 6A, 6B, 6C, 6D, 7A, 7B, 7C, and 7D, the following describes relative positions of the infrared heater 67 and the temperature sensor 65. FIG. 5 is a sectional view of the fixing device 60 showing the relative positions of the temperature sensor 65 and the infrared heater 67.

As described above, the fixing device 60 uses the thin fixing film 61, which has a small heat capacity, as a fixing member. Accordingly, when the fixing film 61 contacts a sheet P and transmits heat to the sheet P, the surface temperature of the fixing film 61 decreases sharply. When the fixing film 61 with the decreased surface temperature rotates and enters the fixing nip N again, the fixing film 61 may cause faulty fixing due to the lowered temperature thereof, resulting in formation of a faulty toner image T on the sheet P. To address this problem, the infrared heater 67 is required to heat a low-temperature portion of the fixing film 61 having the decreased temperature up to a predetermined temperature so that the fixing film 61 does not enter the fixing nip N with the decreased temperature.

To address this requirement, in the fixing device 60, the temperature sensor 65, serving as a temperature detector, is provided downstream from the fixing nip N in the rotation direction R1 of the fixing film 61. The infrared heater 67, serving as a heater, is provided upstream from the fixing nip N in the rotation direction R1 of the fixing film 61. When the temperature sensor 65 detects the decreased temperature of the fixing film 61, the controller 10 depicted in FIG. 1 outputs an ON signal according to the detection result provided by the temperature sensor 65, and controls the infrared heater 67 to heat the low-temperature portion of the fixing film 61 having the decreased temperature up to a predetermined temperature.

However, the fixing film 61 rotates at a predetermined linear velocity (e.g., a circumferential velocity), and the temperature sensor 65 and the infrared heater 67 are electronic parts that both have a response time (e.g., a time constant). Accordingly, when a distance between the temperature sensor 65 and the infrared heater 67 is small, that is, when a circumferential distance A depicted in FIG. 5 is small, the low-temperature portion of the fixing film 61 having the decreased temperature already passes a heating region H in which a distance between the infrared heater 67 and the fixing film 61 is smallest by the time the infrared heater 67 starts heating the fixing film 61. Consequently, the low-temperature portion of the fixing film 61 having the decreased temperature enters the fixing nip N before the low-temperature portion of the fixing film 61 is heated up to a proper fixing temperature.

To address this problem, in the fixing device 60 according to this example embodiment, the distance between the temperature sensor 65 and the infrared heater 67 is long enough for the infrared heater 67 to supply a sufficient amount of heat to the low-temperature portion of the fixing film 61 having the decreased temperature, so that the fixing device 60 provides a proper fixing property. For example, the temperature sensor 65 is positioned with respect to the infrared heater 67 in such a manner that the circumferential distance A between the temperature sensor 65 and the infrared heater 67 satisfies the following formula (1).

$$A \geqq v \times (T1 + T2) \quad (1)$$

where v represents linear velocity (e.g., circumferential velocity) [mm/s] of the fixing film 61, T1 represents response time [s] of the temperature sensor 65, and T2 represents response time [s] of the infrared heater 67.

When time constant is used as an index of response time, the circumferential distance A between the temperature sensor 65 and the infrared heater 67 satisfies the following formula (2).

$$A \geqq v \times (t1 + t2) \quad (2)$$

where v represents linear velocity (e.g., circumferential velocity) [mm/s] of the fixing film 61, t1 represents time constant [s] of the temperature sensor 65, and t2 represents time constant [s] of the infrared heater 67.

FIGS. 6A, 6B, 6C, and 6D illustrate a graph showing temperature distribution of the surface of the fixing film 61 changing over time when the circumferential distance A between the temperature sensor 65 and the infrared heater 67 satisfies the formula (2), that is, A≧v×(t1+t2).

Figure 6A:
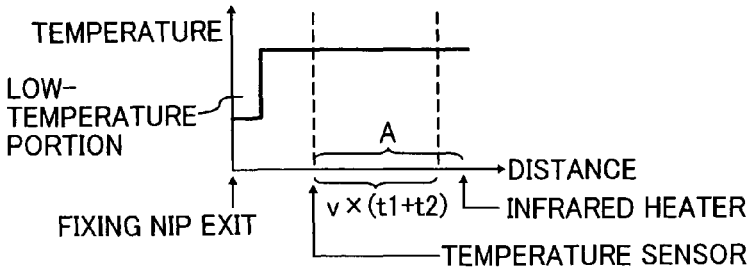
FIG. 6A is a graph showing a surface temperature of a fixing film included in the fixing device shown in FIG. 5 before a decreased temperature of the fixing film is detected in a state in which a predetermined formula is satisfied.
Figure 6B:
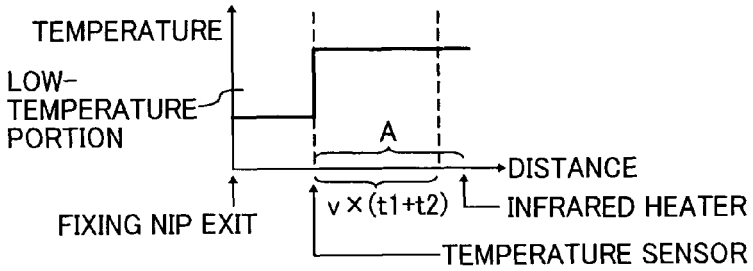
FIG. 6B is a graph showing a surface temperature of a fixing film included in the fixing device shown in FIG. 5 when a decreased temperature of the fixing film is detected in a state in which a predetermined formula is satisfied.
Figure 6C:
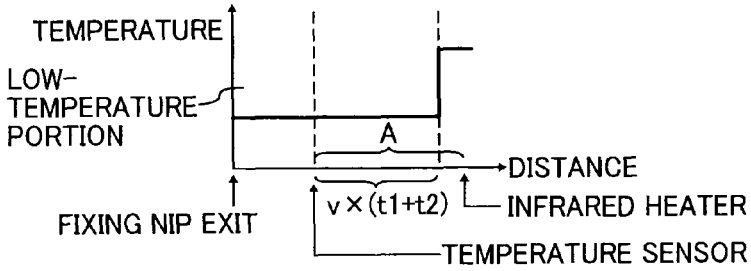
FIG. 6C is a graph showing a surface temperature of a fixing film included in the fixing device shown in FIG. 5 when heat supply is started in a state in which a predetermined formula is satisfied.
Figure 6D:
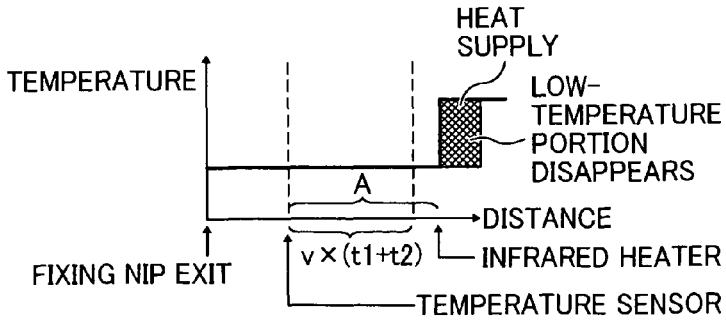
FIG. 6D is a graph showing a surface temperature of a fixing film included in the fixing device shown in FIG. 5 during heat supply in a state in which a predetermined formula is satisfied.

Specifically, FIG. 6A illustrates temperature distribution of the surface of the fixing film 61 before the temperature sensor 65 detects the low-temperature portion of the fixing film 61 having the decreased temperature, that is, immediately after the sheet P is discharged from the fixing nip N. FIG. 6B illustrates temperature distribution of the surface of the fixing film 61 when the temperature sensor 65 detects the low-temperature portion of the fixing film 61 having the decreased temperature. FIG. 6C illustrates temperature distribution of the surface of the fixing film 61 when the infrared heater 67 starts supplying heat to the fixing film 61, that is, when a time period Tp calculated by subtracting the time constant t2 from the time constant t1, that is, Tp=t1−t2, elapses. FIG. 6D illustrates temperature distribution of the surface of the fixing film 61 when the infrared heater 67 supplies heat to the fixing film 61. As illustrated in FIG. 6D, the low-temperature portion of the fixing film 61 having the decreased temperature disappears after the infrared heater 67 supplies heat to the fixing film 61.

By contrast, FIGS. 7A, 7B, 7C, and 7D illustrate a graph showing temperature distribution of the surface of the fixing film 61 changing over time when the circumferential distance A between the temperature sensor 65 and the infrared heater 67 does not satisfy the formula (2), that is, A<v×(t1+t2).

Figure 7A:
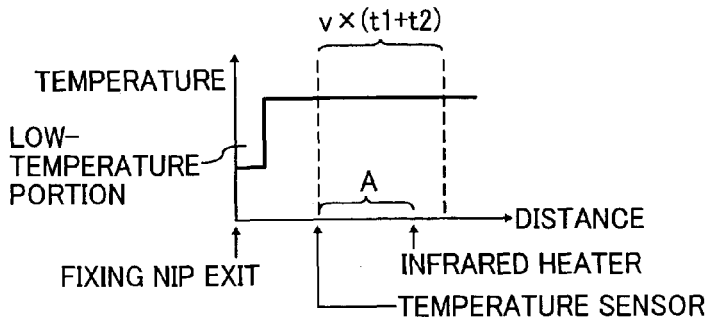
FIG. 7A is a graph showing a surface temperature of a fixing film included in the fixing device shown in FIG. 5 before a decreased temperature of the fixing film is detected in a state in which a predetermined formula is not satisfied.
Figure 7B:
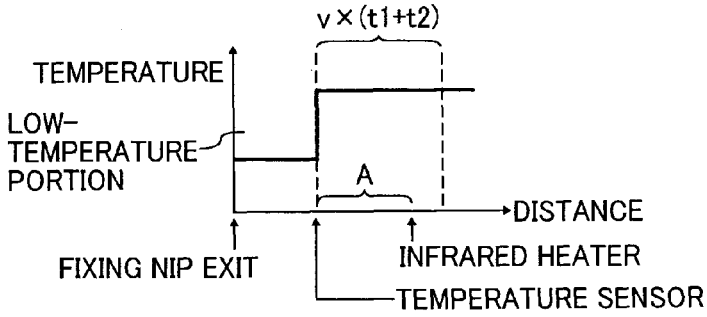
FIG. 7B is a graph showing a surface temperature of a fixing film included in the fixing device shown in FIG. 5 when a decreased temperature of the fixing film is detected in a state in which a predetermined formula is not satisfied.
Figure 7C:
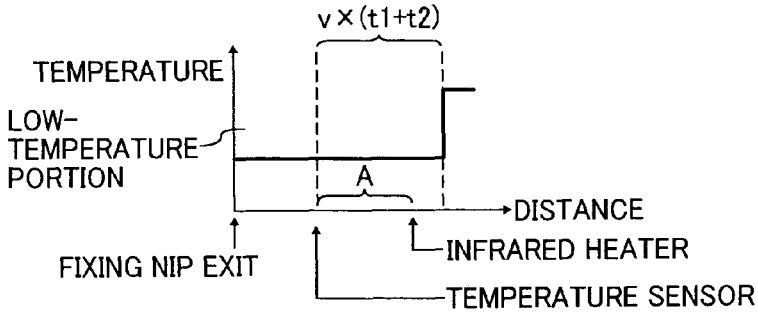
FIG. 7C is a graph showing a surface temperature of a fixing film included in the fixing device shown in FIG. 5 when heat supply is started in a state in which a predetermined formula is not satisfied.
Figure 7D:
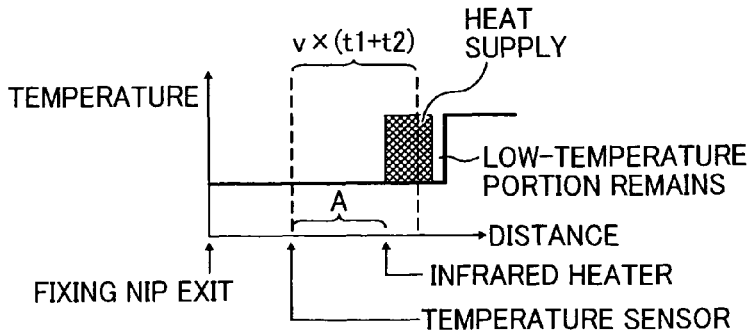
FIG. 7D is a graph showing a surface temperature of a fixing film included in the fixing device shown in FIG. 5 during heat supply in a state in which a predetermined formula is not satisfied.

Specifically, FIG. 7A illustrates temperature distribution of the surface of the fixing film 61 before the temperature sensor 65 detects the low-temperature portion of the fixing film 61 having the decreased temperature, that is, immediately after the sheet P is discharged from the fixing nip N. FIG. 7B illustrates temperature distribution of the surface of the fixing film 61 when the temperature sensor 65 detects the low-temperature portion of the fixing film 61 having the decreased temperature. FIG. 7C illustrates temperature distribution of the surface of the fixing film 61 when the infrared heater 67 starts supplying heat to the fixing film 61, that is, when a time period Tp calculated by subtracting the time constant t2 from the time constant t1, that is, Tp=t1−t2, elapses. FIG. 7D illustrates temperature distribution of the surface of the fixing film 61 when the infrared heater 67 supplies heat to the fixing film 61. As illustrated in FIG. 7D, the low-temperature portion of the fixing film 61 having the decreased temperature remains even after the infrared heater 67 supplies heat to the fixing film 61.

In other words, as illustrated in FIGS. 7A, 7B, 7C, and 7D, when the circumferential distance A between the temperature sensor 65 and the infrared heater 67 does not satisfy the formula (2), the low-temperature portion of the fixing film 61 having the decreased temperature enters the fixing nip N before the low-temperature portion of the fixing film 61 is heated up to the proper temperature.

As for the time constant, for example, when a thermopile, that is, an optical sensor, is used as the temperature sensor 65, the time constant is about 0.1 [s] (=t1). When a carbon heater is used as the infrared heater 67, the time constant is about 0.6 [s]. However, such values are available when the fixing device 60 is heated from an ambient temperature. By contrast, during image forming operation of the image forming apparatus 1, the infrared heater 67 is turned on and off repeatedly at relatively high temperatures, and therefore the infrared heater 67 itself keeps heat. Accordingly, the time constant of the carbon heater is about 0.2 [s] (=t2). When the linear velocity (e.g., the circumferential velocity) of the fixing film 61 is 150 [mm/s] (=v), the circumferential distance A between the temperature sensor 65 and the infrared heater 67 is not smaller than 45 mm, that is, A≧45 [M].

In the fixing device 60 according to the above-described example embodiments, the temperature sensor 65 is provided downstream from the fixing nip N in the sheet conveyance direction. The infrared heater 67 is provided downstream from the temperature sensor 65 and upstream from the fixing nip N in the rotation direction R1 of the fixing film 61. The circumferential distance A between the temperature sensor 65 and the infrared heater 67 is set to a value not smaller than a value obtained by adding the response time of the infrared heater 67 to the response time of the temperature sensor 65 and multiplying the resultant value by the linear velocity (e.g., the circumferential velocity) of the fixing film 61. Accordingly, the fixing device 60 maintains an on-demand property that provides a shortened warm-up time and heat supply as needed. Further, the infrared heater 67, serving as a heater, supplies heat to the low-temperature portion of the fixing film 61 having the decreased temperature precisely, providing a sufficient fixing property. Moreover, the infrared heater 67 does not heat the fixing film 61 at the fixing nip N directly. Accordingly, the temperature of the fixing film 61 does not increase as the fixing film 61 passing through the fixing nip N moves closer to an exit of the fixing nip N in the rotation direction R1 of the fixing film 61. Consequently, the fixing device 60 provides an improved gloss of a toner image T fixed on a sheet P.

As described above, the image forming apparatus 1 including the fixing device 60 is a copier for forming a monochrome toner image on a recording medium. Alternatively, the fixing device 60 may be installed in other image forming apparatuses, such as a color copier for forming a color toner image, a printer, a facsimile machine, a multifunction printer having at least one of copying, printing, scanning, and facsimile functions, and the like. Thus, the fixing device 60 serves as an on-demand fixing device in which the temperature detector (e.g., the temperature sensor 65) detects the surface temperature of the fixing member (e.g., the fixing film 61) having a relatively small heat capacity, and the heater (e.g., the infrared heater 67) supplies a desired amount of heat to the fixing member based on a detection result provided by the temperature detector.

The optical reader 20, the ADF 22, the exposure device 3, the image forming device 4, the transfer device 5, the paper tray portion 7, the bypass tray portion 8, and the output tray portion 9 shown in FIG. 1 are examples, and may have other known structures, respectively, with which the fixing device 60 provides the above-described effects. Further, FIGS. 1 to 5 illustrate examples of the shape and the structure of the components, which may be modified as needed within the scope of the present invention.

In the above-described image forming apparatus 1, time constant is used as response time of electronic parts. Alternatively, time required for response may be measured by experiments to obtain response time of individual electronic parts.

Referring to FIGS. 2 and 5, the following describes effects provided by the fixing device 60.

In a fixing device (e.g., the fixing device 60), a fixing member (e.g., the fixing film 61) includes an endless film as a base layer and is rotatable in a predetermined direction of rotation (e.g., the rotation direction R1). A pressing member (e.g., pressing roller 62) is pressed against a contact member (e.g., the pressing plate 66) via the fixing member to form a fixing nip (e.g., the fixing nip N) between the pressing member and the fixing member. The contact member contacts the inner circumferential surface of the fixing member and presses the fixing member against the pressing member. A temperature detector (e.g., the temperature sensor 65) detects the temperature of the fixing member. A heater (e.g., the infrared heater 67) heats the fixing member. A controller (e.g., the controller 10) controls the heater based on a detection result provided by the temperature detector to heat the fixing member to a predetermined temperature. The temperature detector is disposed with respect to the heater in such a manner that the circumferential distance A between the temperature detector and the heater is not smaller than the value obtained by adding the response time of the heater to the response time of the temperature detector and multiplying the resultant value by the circumferential velocity of the fixing member.

With this configuration, the heater supplies heat to the low-temperature portion of the fixing member having the decreased temperature precisely while the fixing device provides an on-demand property that supplements a required amount of heat with a shortened warm-up time, providing a desired fixing property. Further, the heater does not heat the fixing member at the fixing nip directly. Accordingly, the temperature of the fixing member does not increase as the fixing member moves downstream through the fixing nip in the direction of rotation of the fixing member, improving gloss of a toner image formed on a recording medium.

The temperature detector is provided downstream from the fixing nip in the recording medium conveyance direction. By contrast, the heater is provided upstream from the fixing nip in the recording medium conveyance direction.

With this configuration, the temperature of the fixing member is detected at a position downstream from the fixing nip in the direction of rotation of the fixing member to decrease a circumferential length of the fixing member and downsize the fixing device.

The temperature detector is an optical sensor and the heater is an infrared heater. The response time of the temperature detector is the time constant of the optical sensor, and the response time of the heater is the time constant of the infrared heater.

The contact member is a pressing plate attached to a support member (e.g., the support member 69) having a substantially hollow cylindrical shape. A biasing member (e.g., the compression springs 69*a* and 69*b*) presses the support member against the contact member to cause the contact member, which is provided inside the fixing member, to press the fixing member against the pressing member. The infrared heater is detachably attached inside the support member.

With this configuration, a driving mechanism for driving the fixing device and a pressing mechanism for pressing the fixing member against the pressing member are simplified. Further a pressure release mechanism for releasing pressure applied at the fixing nip is not needed. Accordingly, the heater, which needs replacement with a new one frequently, is replaced easily and quickly, improving maintenance of the fixing device.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device for fixing a toner image on a recording medium, comprising:

an endless fixing member to rotate in a predetermined direction of rotation, formed in a loop;

a pressing member contacting an outer circumferential surface of the fixing member to form a fixing nip between the fixing member and the pressing member through which the recording medium bearing the toner image passes;

a temperature detector facing the fixing member to detect a temperature of the fixing member; and a heater facing the fixing member to heat the fixing member to a predetermined temperature based on a detection result provided by the temperature detector, the heater disposed with respect to the temperature detector with a circumferential distance A between the temperature detector and the heater along a circumference of the fixing member defined by the following formula:

$$A \geqq v \times (T1 + T2)$$

where v is a circumferential velocity of the fixing member rotating in the predetermined direction of rotation, T1 is a response time of the temperature detector, and T2 is a response time of the heater.

2. The fixing device according to claim 1, wherein the fixing member comprises an endless film.

3. The fixing device according to claim 2, further comprising a contact member contacting an inner circumferential surface of the fixing member to press the fixing member against the pressing member to form the fixing nip between the fixing member and the pressing member through which the recording medium bearing the toner image passes.

4. The fixing device according to claim 1, wherein the temperature detector is provided downstream from the fixing nip in a recording medium conveyance direction and the heater is provided upstream from the fixing nip in the recording medium conveyance direction.

5. The fixing device according to claim 4, wherein the temperature detector comprises an optical sensor and the heater comprises an infrared heater, and wherein the response time T1 of the temperature detector is a time constant of the optical sensor, and the response time T2 of the heater is a time constant of the infrared heater.

6. The fixing device according to claim 5, further comprising:

a support member provided inside the loop formed by the fixing member and having a substantially hollow cylindrical shape to support the fixing member; and a biasing member to press the support member against the contact member to cause the contact member to press the fixing member against the pressing member, wherein the contact member comprises a pressing plate attached to the support member, and the infrared heater is detachably attached inside the support member.

7. An image forming apparatus comprising the fixing device according to claim 1.

8. A method of dimensioning a fixing device for fixing a toner image on a recording medium, comprising the steps of:

obtaining a circumferential velocity v of a fixing member rotating in a predetermined direction of rotation, a response time T1 of a temperature detector that detects a temperature of the fixing member, and a response time T2 of a heater that heats the fixing member to a predetermined temperature based on a detection result provided by the temperature detector;

positioning the temperature detector downstream and the heater upstream from a fixing nip formed between the fixing member and a pressing member contacting the fixing member in a recording medium conveyance direction in which the recording medium is conveyed through the fixing nip; and setting a distance A between the temperature detector and the heater along a circumference of the fixing member such that $A \geqq v \times (T1 + T2)$.

* * * * *